US008511683B2

(12) United States Patent
Findlay et al.

(10) Patent No.: US 8,511,683 B2
(45) Date of Patent: Aug. 20, 2013

(54) GAME APPARATUS AND GAME

(76) Inventors: James Bruce Hampton Findlay, Broome (AU); Carolyn Jean Hammond, Broome (AU)

( * ) Notice: Subject to any disclaimer, the term of this patent is extended or adjusted under 35 U.S.C. 154(b) by 487 days.

(21) Appl. No.: 12/531,169

(22) PCT Filed: Mar. 13, 2008

(86) PCT No.: PCT/AU2008/000347

§ 371 (c)(1),
(2), (4) Date: Jan. 22, 2010

(87) PCT Pub. No.: WO2008/109950

PCT Pub. Date: Sep. 18, 2008

(65) Prior Publication Data

US 2010/0133753 A1 Jun. 3, 2010

(30) Foreign Application Priority Data

Mar. 13, 2007 (AU) ..... 2007901280

(51) Int. Cl.
*A63F 9/04* (2006.01)

(52) U.S. Cl.
USPC ..... 273/146

(58) Field of Classification Search
USPC ..... 273/146
See application file for complete search history.

(56) References Cited

U.S. PATENT DOCUMENTS

| | | | | |
|---|---|---|---|---|
| 4,443,012 | A * | 4/1984 | Makovic et al. | 273/292 |
| 4,588,193 | A | 5/1986 | Winston | |
| 5,868,393 | A * | 2/1999 | Williams | 273/299 |
| 5,904,353 | A | 5/1999 | Aldridge | |
| 6,308,955 | B1 * | 10/2001 | Slatter | 273/243 |
| 6,341,779 | B1 * | 1/2002 | Merritt | 273/292 |
| 6,547,247 | B2 * | 4/2003 | Hoyt et al. | 273/292 |
| 6,561,514 | B2 * | 5/2003 | Myles | 273/292 |
| 6,648,648 | B1 * | 11/2003 | O'Connell | 434/188 |
| 6,716,033 | B1 * | 4/2004 | Lassowsky | 434/205 |
| 6,910,893 | B2 * | 6/2005 | Dillhoff | 434/129 |
| 6,948,938 | B1 * | 9/2005 | Tseng | 434/129 |
| 7,118,113 | B2 * | 10/2006 | Hoyt et al. | 273/292 |
| 7,220,126 | B2 * | 5/2007 | Glymph | 434/191 |
| 7,367,564 | B2 * | 5/2008 | Latell | 273/299 |
| 7,771,200 | B2 * | 8/2010 | Schultz | 434/188 |
| 7,950,665 | B2 * | 5/2011 | Treloar | 273/304 |
| 2006/0197281 | A1 * | 9/2006 | Waid et al. | 273/242 |

FOREIGN PATENT DOCUMENTS

| | | |
|---|---|---|
| GB | 860109 | 2/1961 |
| GB | 2338906 A | 12/2000 |

* cited by examiner

*Primary Examiner* — Kurt Fernstrom
*Assistant Examiner* — Dolores Collins
(74) *Attorney, Agent, or Firm* — Brooks Kushman P.C.

(57) ABSTRACT

A set of playing tokens (2, 8, 13, 14, 16) includes a numeric sub-set of playing tokens (2, 8). Each numeric token (2, 8) indicates a first numeric value, wherein a second numeric value is derived from the digit or digits which represent that first numeric value.

9 Claims, 7 Drawing Sheets

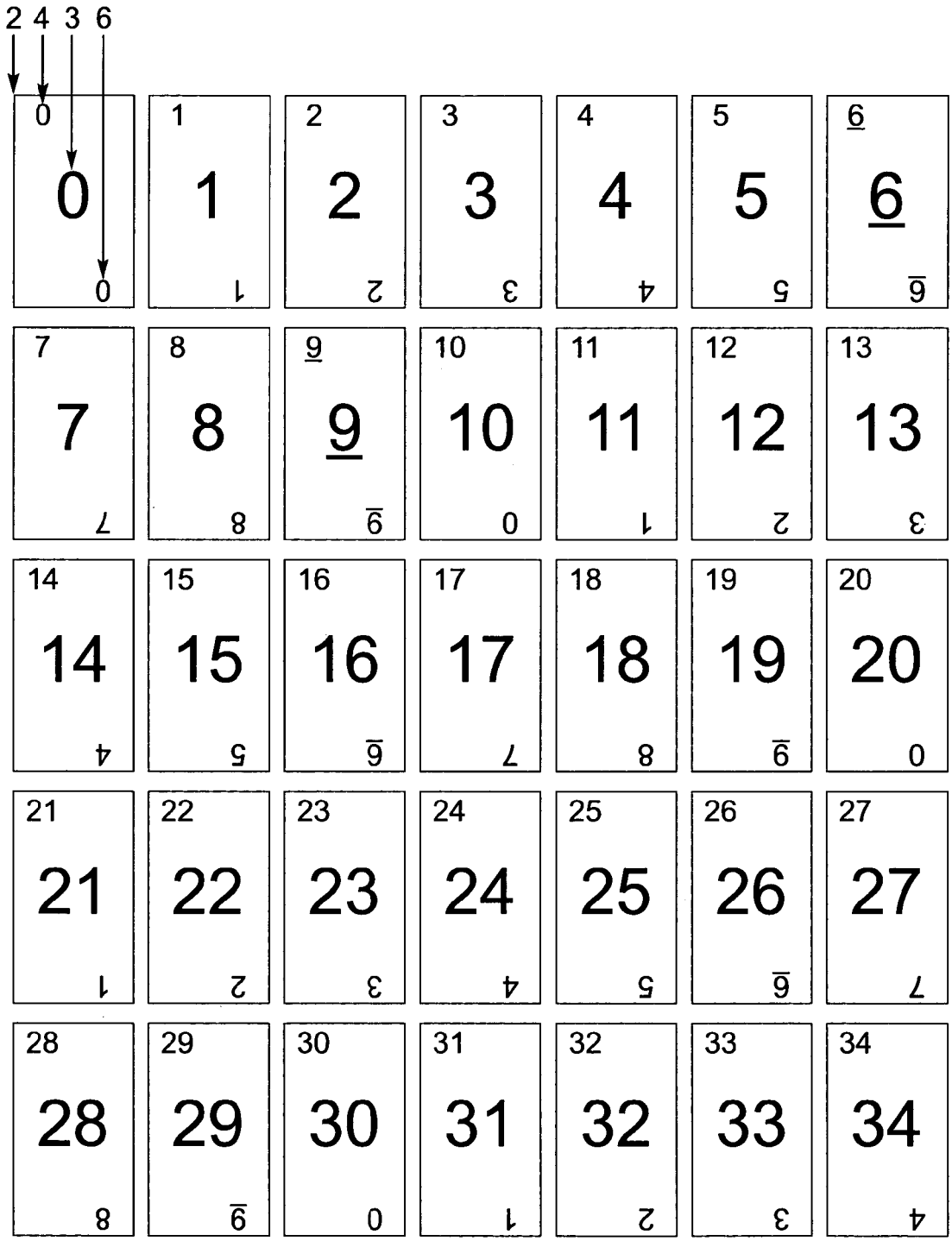
Figure 1 (Part A)
Figure 1 continues at Figure 1 (Part B)

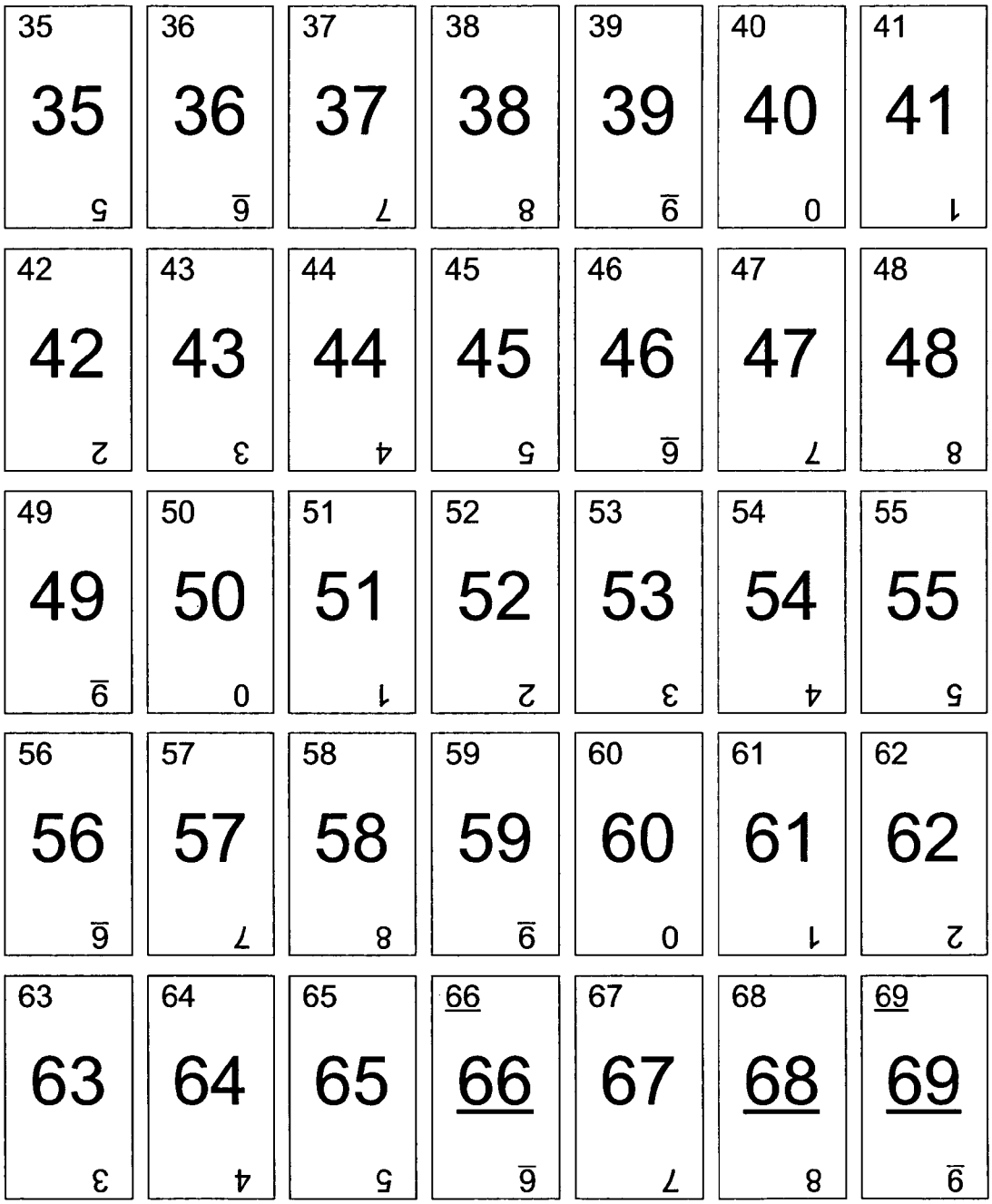
Figure 1 (Part B)
Figure 1 Continues at Figure 1 (Part C)

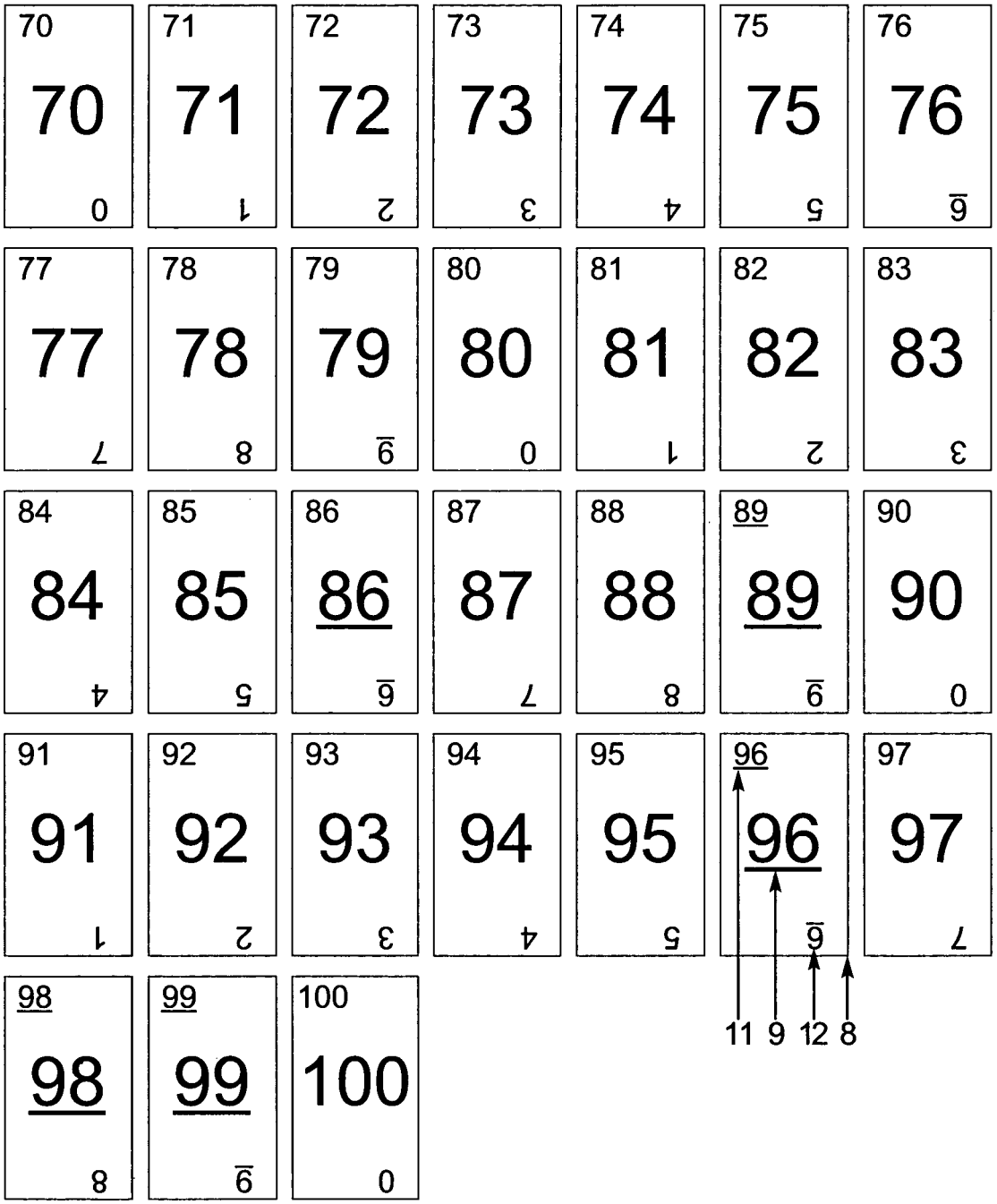
Figure 1 (Part C)
End of Figure 1

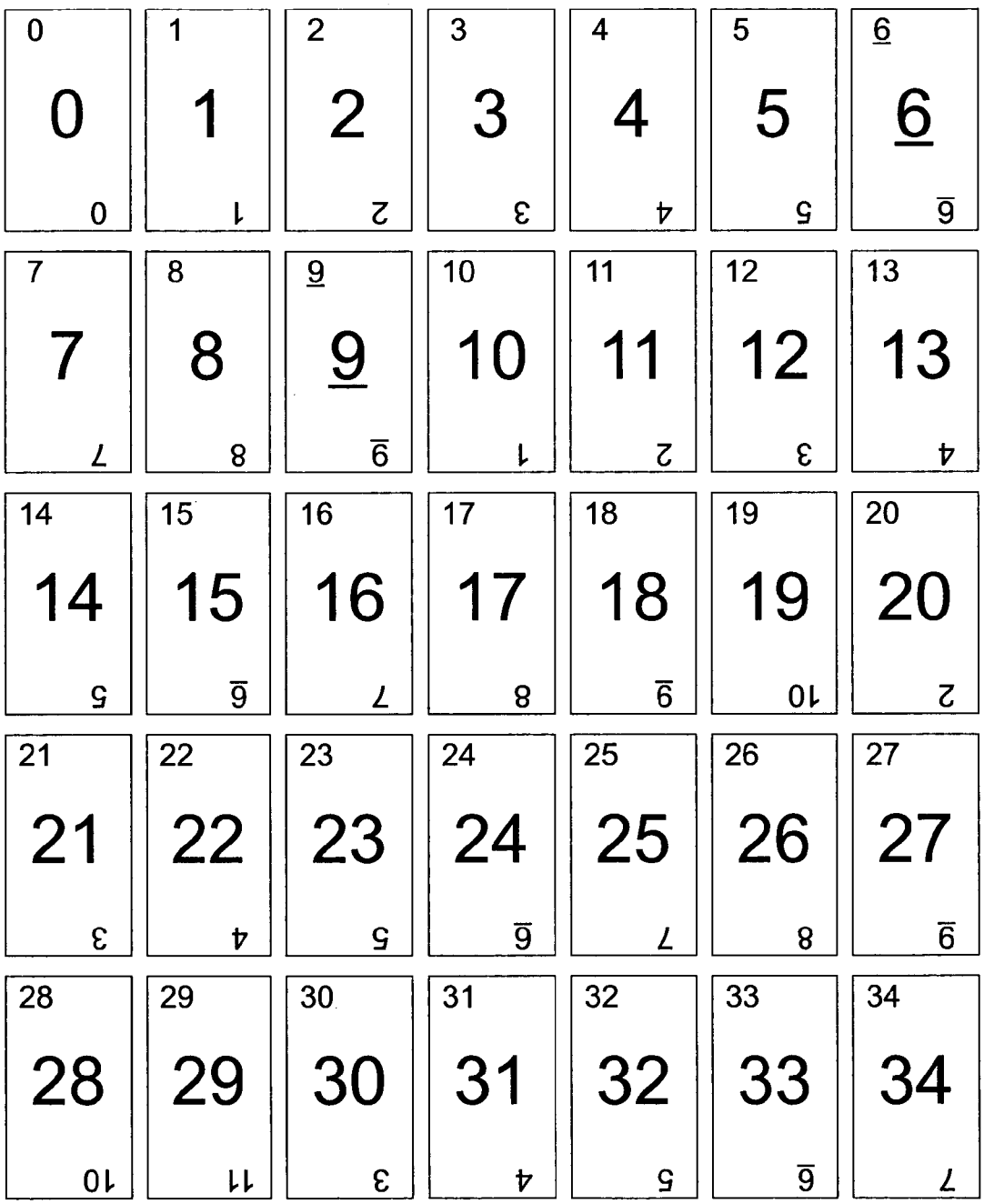
Figure 3 (Part A)
Figure 3 Continues at Figure 3 (Part B)

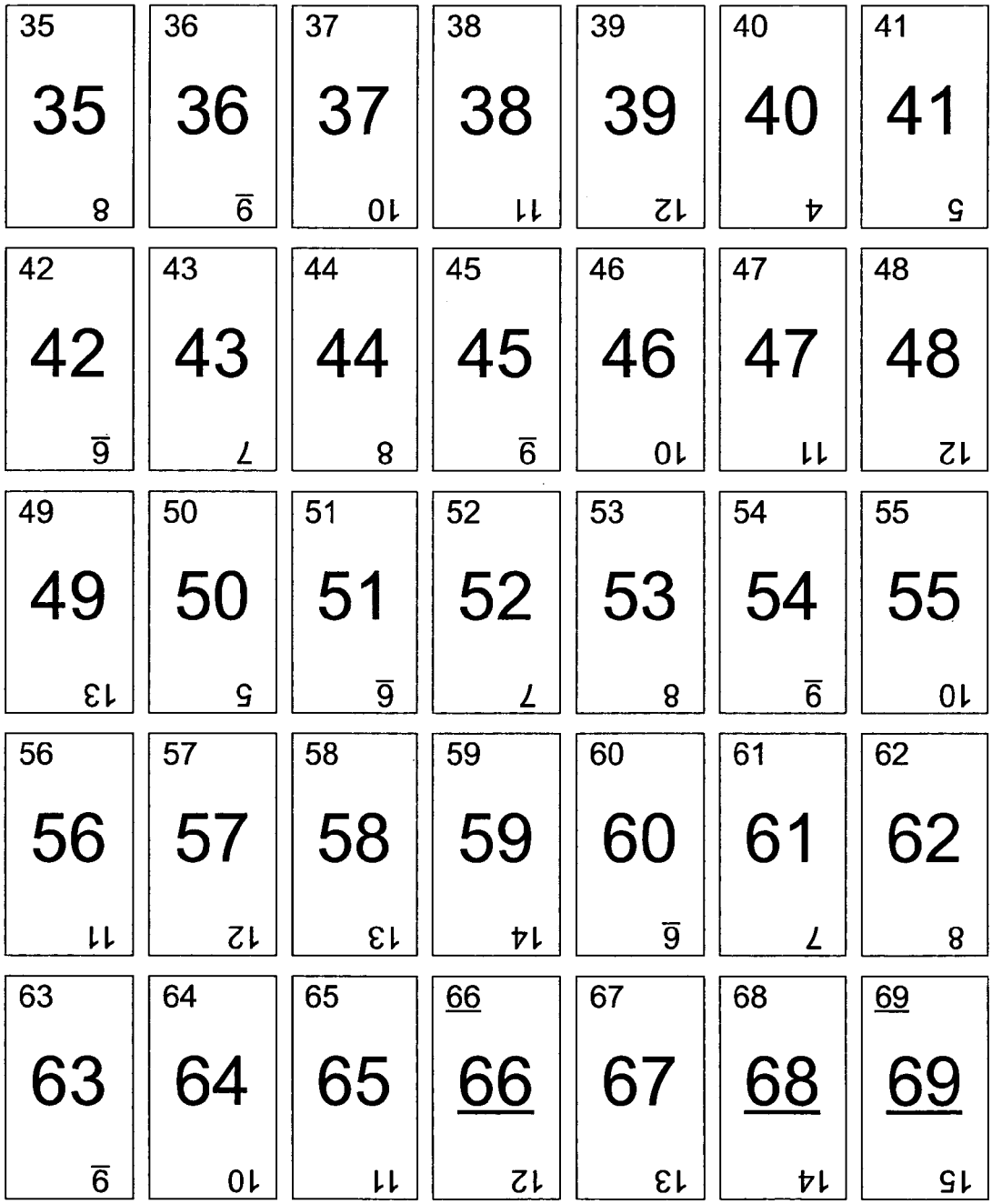
Figure 3 (Part B)
Figure 3 Continues at Figure 3 (Part C)

| | | | | | | |
|---|---|---|---|---|---|---|
| 70 | 71 | 72 | 73 | 74 | 75 | 76 |
| 77 | 78 | 79 | 80 | 81 | 82 | 83 |
| 84 | 85 | 86 | 87 | 88 | 89 | 90 |
| 91 | 92 | 93 | 94 | 95 | 96 | 97 |
| 98 | 99 | 100 | | | | |

Figure 3 (Part C)

End of Figure 3

GAME APPARATUS AND GAME

FIELD OF THE INVENTION

The present invention relates to "card games" and the like that may be played with tokens which indicate values.

In some embodiments of the invention, such tokens are implemented in a form of tangible items similar to traditional playing cards and in other embodiments of the invention such tokens are implemented in electronic form. Throughout this specification, including the claims:

- the word "token" is used to include any form of token, be it hard-copy, electronic, or other form, which is capable of indicating at least one value that is attributable to that token and which is perceivable on that token by use of at least one human sense;
- the word "perceivable" is used to include all manners in which a phenomenon is perceivable by use of the human senses, be it by vision, hearing or touch (including by using Braille); and
- the phrase "numeric value" is used to include any form of numeric value denoted by characters known variously as digits, numerals or numbers, be it that the characters that indicate the numeric value are European numerals, Arabic numerals, Roman numerals, Chinese characters, or other forms, which are capable of denoting a numeric value.

BACKGROUND OF THE INVENTION

Packs of playing cards, comprising fifty-two cards each denoting a different value of one of four common suits (clubs, diamonds, hearts and spades) have a long and ancient history. There are many traditional card games which can be played with such a standard pack of playing cards. However, in general, a standard pack of playing cards can be used only in games in which utilize either, or both of:

- the ranking of a card within a suit, from "1", ie "ace", to "10", then through the royal cards of "jack", "queen" and "king"; and
- the "suit" of a card;

In contrast, the present invention aims at providing tokens with different markings which can be used in games in ways which differ from the standard pack of playing cards.

SUMMARY OF THE INVENTION

In one aspect the present invention accordingly provides a set of playing tokens comprising:

- a numeric sub-set of playing tokens, each member of which sub-set indicates a first numeric value, wherein a second numeric value can be derived from the digits which represent that first numeric value.

It is preferred that each member of the numeric sub-set of tokens additionally indicates the second numeric value of that playing token.

It is preferred that the numeric sub-set of playing tokens further comprises tokens each of which indicates a single first numeric value which is in the range of from "10" to "99" inclusive. In this case it is preferred that no two tokens in the numeric sub-set indicate the same first numeric value. It is particularly preferred that there are 90 tokens in the numeric sub-set of tokens.

It is preferred that the numeric sub-set of playing tokens further comprises a token which indicates the first numeric value of "100".

It is preferred that the second numeric value is the last digit of the first numeric value. Alternatively, it is preferred that the second numeric value is the sum of at least two of the digits of the first numeric value.

It is preferred that the set of playing tokens comprises a further sub-set of playing tokens, each member of which further sub-set indicates a first numeric value which is in the range of from "0" to "9" inclusive.

It is preferred that the set of playing tokens further comprises an operator sub-set of playing tokens, each member of which operator sub-set indicates a mathematical operator.

It is preferred that the mathematical operator indicated on a member of the operator sub-set of tokens is chosen from the group consisting of: "+" [addition], "−" [subtraction]; "×" [multiplication]; "÷" [division]; "=" [equality]; "%" [percentage]; "(" [left parenthesis], and ")" [right parenthesis].

It is preferred that the set of playing tokens further comprises a "luck" sub-set of cards, each of which cards in the "luck" sub-set carries an indicator which traditionally signifies luck. It is particularly preferred that there are three cards in the luck sub-set of cards.

In another aspect, the present invention provides a game played by at least one player, using a set of tokens, the set of tokens comprising:

- a sub-set of numeric tokens, each of which numeric tokens indicates a first numeric value, from which first numeric value a second numeric value can be derived, the game comprising the at least one player making at least one decision in the course of the game, that at least one decision depending on at least one of:

- the first numeric value of at least one of the tokens of the set of tokens; and
- the second numeric value of at least one of the tokens of the set of tokens.

It is preferred that the game further comprises the step of the player deriving the second numeric value from the first numeric value in order to make the at least one decision. Alternatively, it is preferred that each member of the numeric sub-set of tokens additionally indicates the second numeric value of that playing token.

It is preferred that the numeric sub-set of playing tokens further comprises tokens each of which indicates a single first numeric value which is in the range of from "10" to "99" inclusive. It is particularly preferred that there are 90 tokens in the numeric sub-set of tokens.

It is preferred that the numeric sub-set of playing tokens further comprises a token which indicates the first numeric value of "100".

It is preferred that the second numeric value is the last digit of the first numeric value. Alternatively, it is preferred that the second numeric value is the sum of at least two of the digits of the first numeric value.

It is preferred that the set of tokens further comprises a further sub-set of playing tokens, each member of which further sub-set indicates a first numeric value which is in the range of from "0" to "9" inclusive.

It is preferred that the set of tokens further comprises an operator sub-set of playing tokens, each member of which operator sub-set indicates a mathematical operator.

It is preferred that the mathematical operator indicated on a member of the operator sub-set of tokens is chosen from the group consisting of: "+" [addition]; "−" [subtraction]; "×" [multiplication]; "÷" [division]; "=" [equality]; "%" [percentage]; "(" [left parenthesis], and ")" [right parenthesis].

It is preferred that the set of tokens further comprises a "luck" sub-set of tokens, each of which tokens in the "luck"

sub-set carries an indicator which traditionally signifies luck. It is particularly preferred that there are three cards in the luck sub-set of tokens.

BRIEF DESCRIPTION OF THE DRAWINGS

Preferred embodiments of the invention are described below with reference to the following drawings in which FIGS. 1, 2 and 3 illustrate faces of tokens.

DESCRIPTION OF PREFERRED EMBODIMENTS OF THE INVENTION

Figure 2:
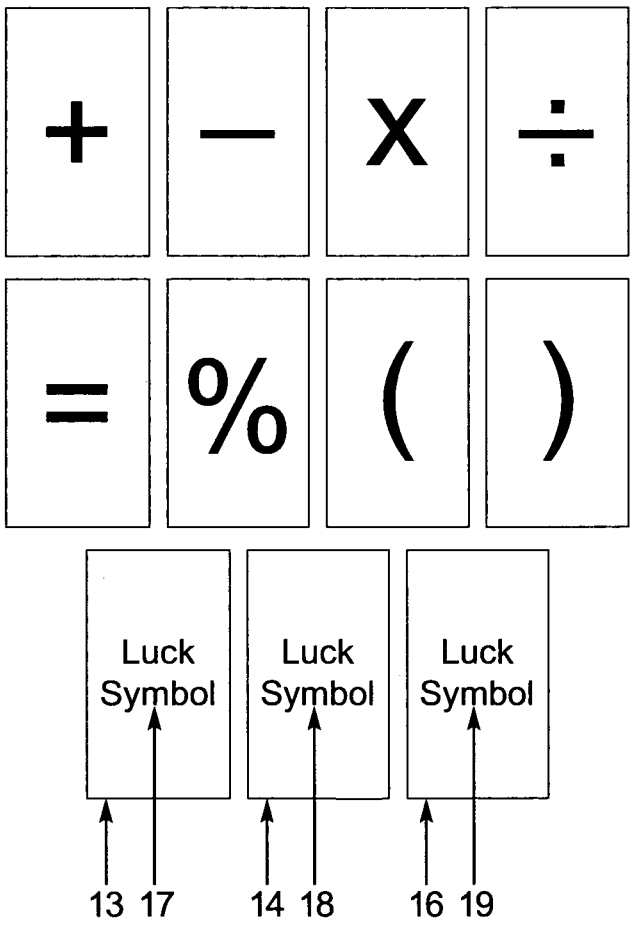

A set of tokens according to one preferred embodiment of the present invention is illustrated with reference to FIGS. 1 and 2.

According to the embodiment which is illustrated in these figures, a set of tokens comprises 101 numeric tokens, each of which indicates a first numeric value, being one of the numbers "0" to "100". According to this embodiment of the inventions, the tokens are each playing cards similar to traditional playing cards. Each card is made from thin, but strong and flexible, cardboard with various indicia printed on it. As with traditional playing cards, one surface of the card is printed with a neutral pattern which does not reveal the contents of the other side of the card.

This first numeric value is indicated (with reference to the token referenced by the reference number 2 in FIG. 1) centrally such as the number "0", indicated by the reference number 3. This first numeric value is printed in large font and centrally placed on one side of the card 2. The first numeric value is also printed, in smaller font, at 4 in the corner of the card 2 that is at the top left in FIG. 1.

In the card 8, the first numeric value "96" is indicated by reference number 9. This first numeric value is also printed at the 11 in the corner of the card 8 that is at the top left in FIG. 2.

A second numeric value is also placed on each of the 101 cards according to the embodiment of FIGS. 1 and 2. In this embodiment, the second numeric value is the last digit of the first numeric value. This second numeric value is printed on the face of the card, at the corner diagonally opposite the corner at which the first numeric value is printed. On the card 2 in FIG. 1, the second numeric value appears at 6. In the card 8 of FIG. 2, the second numeric value "9" of that card is printed at 12 on that card. To avoid ambiguity between the digit "6" and the digit "9", the digit "6" on card 8 is printed with an underscore beneath it to indicate the correct orientation of the digit.

The set of playing cards according to the embodiment of FIGS. 1 to 3 also comprises three "luck" cards which are indicated at 13, 14 and 16 in FIG. 2. Each of these "luck" cards carries a "luck" symbol, indicated at 17, 18 and 19 respectively in FIG. 2.

The set of playing cards according to the embodiment of FIGS. 1 and 2 also comprises 8 numeric operator cards, as is illustrated in FIG. 2. Each of these numeric operator cards carries a numeric operator, namely, one of: "+" [addition]; "−" [subtraction]; "×" [multiplication]; "÷" [division]; "=" [equality]; "%" [percentage]; "(" [left parenthesis], and ")" [right parenthesis].

A further preferred embodiment of the invention which is illustrated in FIGS. 3 and 2 of the drawings differs from the embodiment of FIGS. 1 and 2 only in that the second numeric value of each card is derived by addition of the digits of the its numeric value.

Annex 1 to this specification sets out a set of rules which is appropriate to modified forms of poker which exploit features of playing cards according to embodiments of the present invention.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

'Comprises/comprising' when used in this specification is taken to specify the presence of stated features, integers, steps or components but does not preclude the presence or addition of one or more other features, integers, steps, components or groups thereof.

The invention claimed is:

1. A set of playing tokens comprising:

a subset of playing tokens, each playing token in the subset having a first numeric value disposed on a central region of the playing token and having two digits, the first numeric value being in the range of "10" to "99" inclusive, a second numeric value disposed on another corner region of the playing token and having exactly one digit, wherein the second numeric value is equivalent in value to one of the two digits of the first numeric value, and a third numeric value disposed on one corner region of the playing token and having two digits, wherein the third numeric value is equivalent in value to the first numeric value.

2. A set of playing tokens as claimed in claim 1, wherein no two tokens in the sub-set indicate the same first numeric value.

3. A set of playing tokens as claimed in claim 2, wherein there are 90 tokens in the sub-set of tokens.

4. A set of playing tokens as claimed in claim 1, wherein the sub-set of playing tokens further comprises a token which indicates the first numeric value of "100".

5. A set of playing tokens as claimed in claim 1, wherein the second numeric value of each of the playing tokens is equivalent in value to the last digit of the first numeric value.

6. A set of playing tokens as claimed in claim 1, further comprising a second sub-set of playing tokens, wherein each member of the second sub-set indicates a first numeric value which is in the range of from "0" to "9" inclusive.

7. A set of playing tokens as claimed in claim 1, further comprising a "luck" sub-set of tokens, each of which tokens in the "luck" sub-set carries an indicator which traditionally signifies luck.

8. A set of playing tokens as claimed in claim 7, wherein there are three tokens in the luck sub-set of tokens.

9. A set of playing tokens as claimed in claim 1, herein the sub-set of playing tokens includes at least 50 playing tokens.

* * * * *